US006444959B1

(12) United States Patent
Itoh

(10) Patent No.: US 6,444,959 B1
(45) Date of Patent: Sep. 3, 2002

(54) APPARATUS AND METHOD FOR CONTROLLING THE PREHEATING TEMPERATURE

(75) Inventor: Tomohiko Itoh, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/915,544

(22) Filed: Jul. 27, 2001

(30) Foreign Application Priority Data

Jul. 28, 2000 (JP) ..... 2000-228728

(51) Int. Cl.[7] ..... H05B 1/02

(52) U.S. Cl. ..... 219/492; 219/216; 219/497; 346/76.1

(58) Field of Search ..... 219/216, 497, 219/501, 506, 492; 315/194, 291; 346/76.1

(56) References Cited

U.S. PATENT DOCUMENTS 4,560,992 A * 12/1985 Hakoyama ..... 346/76 PH
5,262,799 A * 11/1993 Ono et al. ..... 346/76 PH
5,451,988 A * 9/1995 Ono ..... 347/185
6,201,354 B1 * 3/2001 Kokubo ..... 315/194

* cited by examiner

*Primary Examiner*—Mark Paschall
(74) *Attorney, Agent, or Firm*—Sughrue Mion, PLLC

(57) ABSTRACT

The apparatus and method control preheating temperature of equipment having a device to be preheated and a preheating device for start-up which includes a heat source and a heat source control device which has a plurality of heating patterns to control said heat source. The apparatus includes a temperature measuring device for measuring current temperature of the device to be preheated within the equipment, a computing device for calculating a predicted time that is required by the preheating device to preheat the device from the current temperature to a preset temperature, a comparison device by which the predicted time as calculated by the computing device is compared with a specified start-up time and a selecting device for selecting from the plurality of heating patterns within the heat source control device a heating pattern that makes the predicted time shorter than the start-up time. The method controls such that if the predicted time is longer than the specified start-up time, another heating pattern is selected and the predicted time is calculated again so that an appropriate heating pattern is selected by repeating the selection, the computation and the comparison until the predicted time becomes shorter than the specified start-up time.

10 Claims, 4 Drawing Sheets

APPARATUS AND METHOD FOR CONTROLLING THE PREHEATING TEMPERATURE

BACKGROUND OF THE INVENTION

This invention relates to an apparatus and a method for controlling the preheating temperature of equipment having a preheating device for start-up. The invention relates particularly to an apparatus and a method for controlling the preheating temperature to ensure that preheating will end within a specified start-up time.

To record ultrasonic diagnostic images, thermal recording is currently employed that uses thermal films having a heat-sensitive recording layer formed on a transparent film base. Since thermal recording has several advantages such no need for wet development and the ease of handling, its application is not limited to the recording of small-size images as in ultrasonic diagnosis but has recently expanded to uses such as MRI and X-ray diagnoses that require large and high-quality images.

The apparatus for performing heat-sensitive image recording is commonly called a thermal printer and has a thermal head to perform heat-sensitive image recording on the thermal film. In order to record a sharp ultrasonic diagnostic image on the thermal film by device of the thermal head, it is necessary to control the temperature of the thermal head and to this end, the thermal head is equipped with a preheating device for raising the temperature to a specified level, as well as a cooling fan for cooling the thermal head if its temperature is too high.

The preheating device is commonly an electric heater, or a heat source of a type that produces heat upon current impression The life of the heat source is considerably shortened if current is impressed continuously for a prolonged period or if high voltage is applied in order to attain higher temperatures. To avoid this problem, heating is generally performed by impressing an electric current according to a specified pattern that consists of intermittent heating at constant voltage. However, if this approach is taken, the required preheating time varies with the temperature prior to heating and it is difficult to predict the waiting time, or the time the equipment requires to become operable after the power supply is switched on.

In addition to the thermal printer for recording ultrasonic diagnostic images, many models of medical equipment have a device of preheating to a specified temperature before they start to operate. However, such preheating device is only capable of preheating according to a specified pattern after the power supply is switched on and no consideration has been given to controlling the time taken by the preheating step. The waiting time is difficult to predict and even in a case of emergency, an unduly prolonged preheating time is spent.

SUMMARY OF THE INVENTION

The present invention has been accomplished under these circumstances and has as an object providing an apparatus for controlling the preheating temperature such that preheating ends within a specified start-up period to ensure positive prediction of the waiting time so that the lapse of an unduly prolonged preheating time can be avoided and which, in a case of emergency, sets a shorter preheating time to minimize the period for which the user has to wait.

Another object of the invention is to provide a method for controlling the preheating temperature with the above-described apparatus.

In order to attain the object described above, the first aspect of the present invention provides an apparatus for controlling preheating temperature of equipment having a device to be preheated and a preheating device for start-up, the preheating device including a heat source and a heat source control device which has a plurality of heating patterns to control the heat source, the apparatus comprising: a temperature measuring device for measuring current temperature of the device to be preheated within the equipment; a computing device for calculating a predicted time that is required by the preheating device to preheat the device from the current temperature to a preset temperature; a comparison device by which the predicted time as calculated by the computing device is compared with a specified start-up time; and a selecting device for selecting from the plurality of heating patterns within the heat source control device a heating pattern that makes the predicted time shorter than the start-up time.

In order to attain another object described above, the second aspect of the present invention provides a method for controlling preheating temperature of equipment having a device to be preheated and a preheating device for start-up, comprising: a current temperature measuring step for measuring current temperature of the device to be preheated within the equipment at start of preheating the device to be preheated by the preheating device; a selection step for selecting one of the heating patterns possessed by the preheating device within the equipment; a computing step for calculating a predicted time that is required to preheat the device to be preheated from the current temperature to a preset temperature; and a comparison step for comparing the predicted time with a specified start-up time; wherein if the predicted time is longer than the specified start-up time, another heating pattern is selected and the predicted time is calculated again so that an appropriate heating pattern is selected by repeating respective selection, computing and comparison steps until the predicted time becomes shorter than the specified start-up time.

Preferably, the specified start-up time can be set at a desired value.

Preferably, the equipment is medical equipment.

Preferably, the preheating device is one for the medical equipment.

Preferably, the device to be preheated is a thermal head in a thermal printer which prints out image data being output from the medical equipment and the preheating device is one for preheating the thermal head.

DETAILED DESCRIPTION OF THE INVENTION

Figure 1:
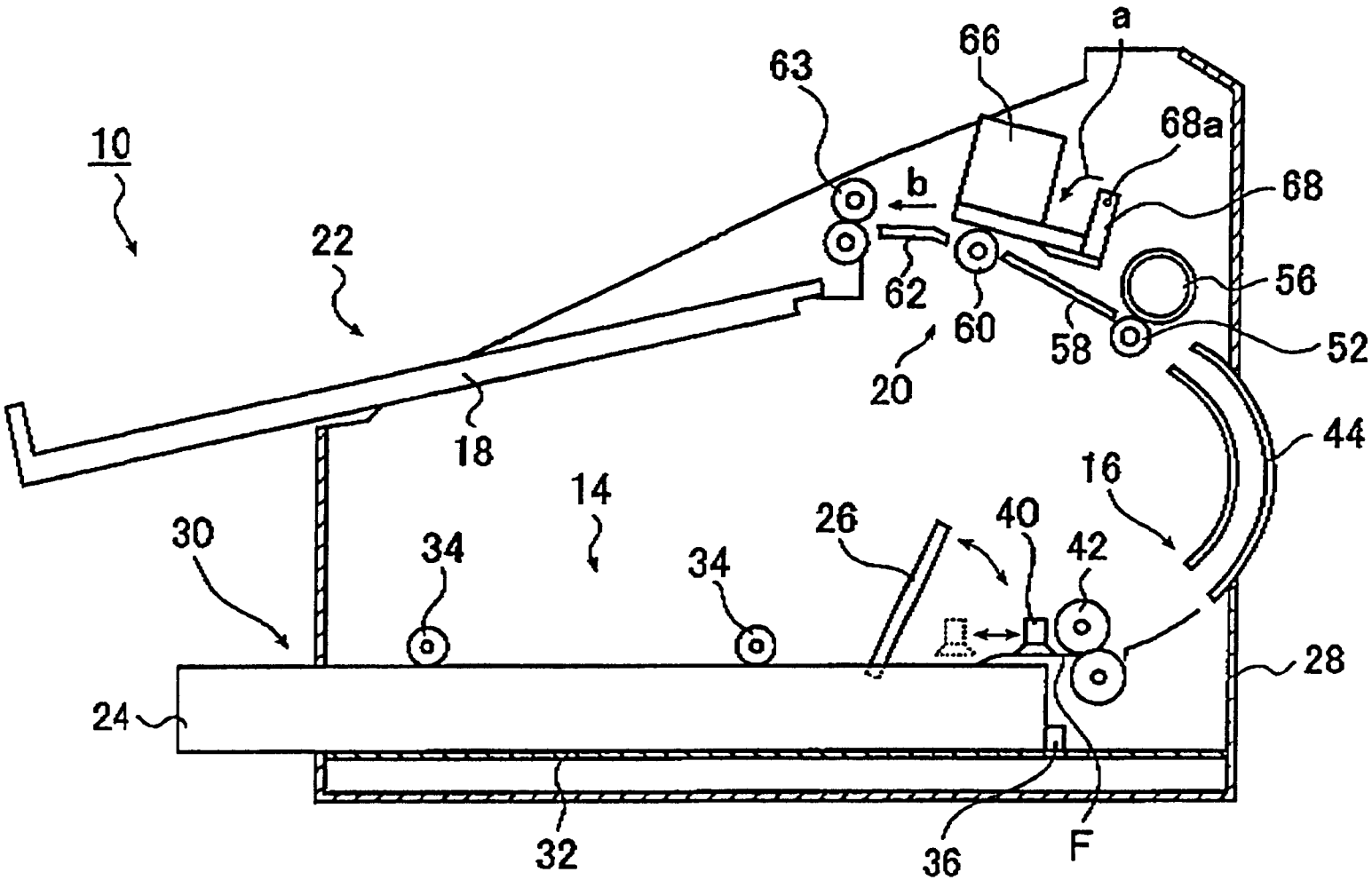
FIG. 1 shows in conceptual form a thermal printer that adopts the apparatus of the invention for controlling the preheating temperature.

FIG. 1 shows in conceptual form a thermal printer that adopts the apparatus and method of the invention for controlling the preheating temperature. The thermal printer generally indicated at 10 is intended to perform heat-sensitive image recording on a thermal recording film F (hereunder referred to simply as "film F") of a specified size, say, B4 size. As shown, the thermal printer 10 has the following sections as main components: a loading section 14 which is loaded with a magazine 24 for holding the film F in position; a transport supply section 16 through which the film F is transported between transport guides 44 to be supplied to a position beneath a thermal head 66; an image recording section 20 in which the as-supplied film F is subjected to thermal image recording with the thermal head 66; and an ejecting section 22 for ejecting the thermally recorded film F into a tray 18.

The film F comprises a transparent film base such as a transparent polyethylene terephthalate (PET) film having a heat-sensitive recording layer formed on one side. A specified number of films F, say, 100 films are stacked within the magazine 24 and picked up one by one at a specified timing so that thermal recording is done on the heat-sensitive recording layer by device of the thermal head 66.

The loading section 14 has a slot 30 formed in the housing 28 of the thermal printer 10 and it has a guide plate 32, guide rolls 34 and a stopper member 36 as basic components. The magazine 24 is inserted into the loading section 14 via the slot 30 and as it passes by the guide plate 32 and guide rolls 34, the magazine 24 is pushed forward until it contacts the stopper member 36, whereupon it is loaded in a specified position within the thermal printer 10.

In the transport supply section 16, each film F as picked up from the magazine 24 in the loading section 14 is transported and supplied to the image recording section 20. The transport supply section 16 consists basically of a film pickup mechanism, a nip roller drive mechanism and transport guides 44. The film pickup mechanism picks up films F in the magazine 24 one by one by device of suckers 40 and feeds each film F until its leading end gets into a nip roller pair 42. The nip roller drive mechanism drives the nip rollers 42 to rotate at specified timings and at a specified rotating speed. The transport guides 44 are used to guide the film F as it is transported by the rotation of the nip rollers 42.

The image recording section 20 consists of the following basic components: thermal head 66, a platen roller 60, a cooling fan (not shown) for cooling the thermal head 66, a cleaning roller 56 and its backup roller 52, guides 58 and 62, and an ejection roller pair 63.

Figure 2:
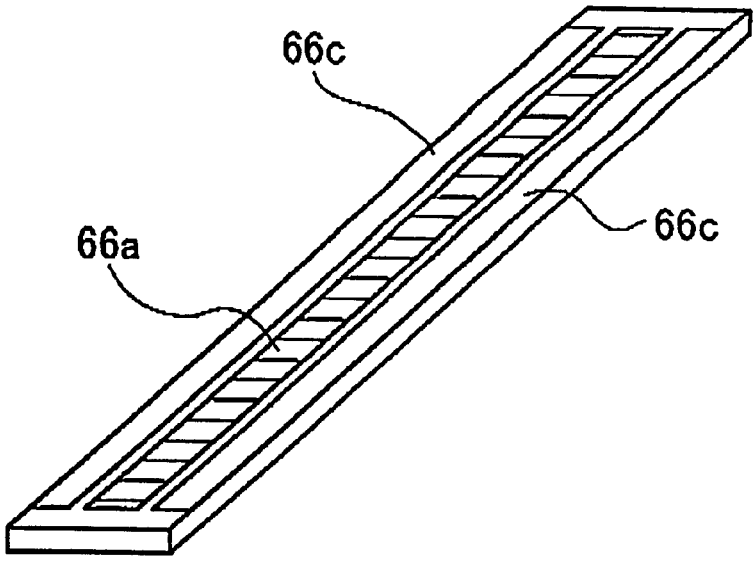
FIG. 2 is a perspective view of a heat source 66*c* as a preheating device which is provided around the heating elements in a thermal head body 66*a* which is to be preheated by the method of the invention.

The thermal head 66 is typically designed to perform thermal image recording at a recording (pixel) density of 300 dpi and as shown in FIG. 2, it has a thermal head body 66*a* and a heat sink 66*b* fixed thereto. The thermal head body 66*a* has a glaze which is a unidirectional array of heating elements for performing one line of thermal recording on the film F. Heat source 66*c* working as the preheating device is provided around the heating elements in the thermal head body 66*a*.

This design allows the combination of the above-mentioned cooling fan and the heat source 66*c* to maintain the thermal head body 66*a* at a specified temperature, say, 25° C.±3° C. The thermal head 66 of this design is supported by a support member 68 which is capable of pivoting about a fulcrum 68*a* in two directions, one being indicated by arrow a and the other being opposite.

Platen roller 60 not only holds the film F in a specified position but also rotates to provide a specified image recording speed so that the film F is transported in an auxiliary scanning direction which is substantially perpendicular to the main scanning direction in which the glaze is formed on the thermal head 66. Cleaning roller 56 and its backup roller 52 are respectively an adhesive rubber roller and an ordinary rubber roller, and the cleaning roller 56 made of an adhesive rubber cleans the surface of the heat-sensitive layer of the film F.

By device of guide 58, the film F which has been cleaned by passage between cleaning roller 56 and its backup roller 52 is guided and transported to a position beneath the thermal head 66. By device of guide 62, the film F which has been thermally recorded with the thermal head 66 is directed toward the ejection roller pair 63.

The film F which has been transported to a position beneath the ejection roller pair 63 is ejected into the tray 18 by rotation of the ejection roller pair 63. The cleaning roller 56 and its backup roller 52, the platen roller 60 and the ejection roller pair 63 should be rotated in synchronism so that they provide completely identical transport speeds to prevent the formation of wrinkles and other surface defects on the film F.

Thermal printer 10 of the example under discussion operates in the following manner. In response to a command for the start of recording, the mechanism (not shown) for opening and closing the magazine 24 is activated and the cover 26 of the magazine 24 is opened as shown in FIG. 1; then, suckers 40 in the film pickup mechanism suck one of the films F in the magazine 24, pick it up and bring its leading end into the gap between the two nip rollers 42. As the nip roller pair 42 is driven with the nip roller drive mechanism, the suckers 40 release the film F, which is then passed between the transport guides 44 and transported toward the image recording section 20 by rotation of the nip rollers 42.

At the point in time when its leading end has reached a position beneath the cleaning roller 56, the film F makes a temporary stop and a check is made of the temperature of the thermal head 66. If the temperature of the thermal head 66 is normal, the film F is transported to the image recording section 20 by rotation of the cleaning roller 56 and its backup roller 52.

Thermal head 66 in the image recording section 20 is such that before the transport of the film F is started, the support member 68 has pivoted up (opposite the direction indicated by arrow a) so that the glaze in the thermal head 66 maintains a certain clearance from the platen roller 60 (the two do not contact each other). If the film F is pinched between the cleaning roller 56 and the backup roller 52 and transported past the guide 58 until its leading end reaches the recording start position (which corresponds to the glaze), the support member 68 pivots down (in the direction indicated by arrow a) so that the film F is pinched between the glaze in the thermal head 66 and the platen roller 60, causing the glaze to come into contact with the heat-sensitive recording layer of the film F. Thereafter, the film F is not only held in a specified position by the platen roller 60 but also transported by its rotation.

In synchronism with the transport of the film F, heating elements in the glaze are heated in accordance with input image data, thereby recording an image on the film F that corresponds to the image data. The film F which has passed through the step of thermal image recording is moved past the guide 62 and transported by the platen roller 60 and the ejection roller pair 63 so that it is ejected into the tray 18 in the ejecting section 22. Tray 18 projects outwardly from the thermal printer 10, so the film F with the recorded image can be recovered from the tray 18 if this is necessary.

Figure 3:
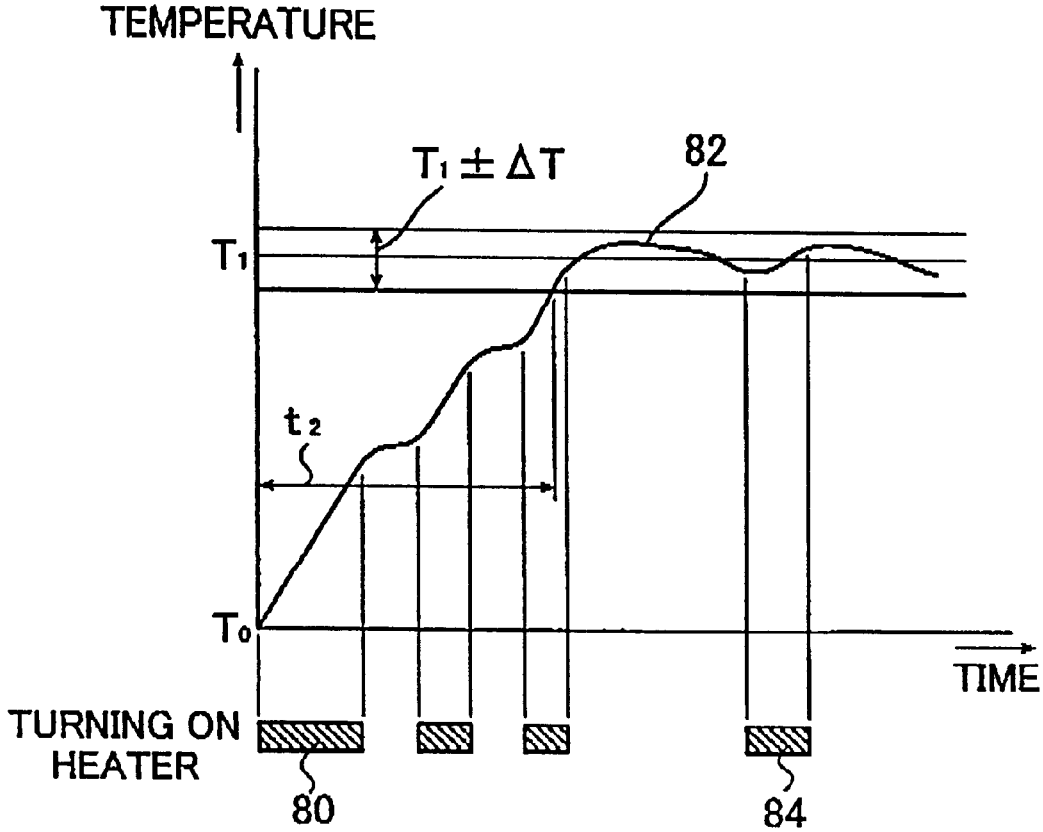
FIG. 3 is a graph showing the time-dependent change in the temperature of the thermal head body 66*a* being preheated.

As already mentioned, the thermal printer 10 of the example under discussion is such that the preheating device 66*c* is provided around the thermal head body 66*a* having the glaze. For preheating the thermal head body 66*a,* an intermittent heating mode of the pattern depicted in FIG. 3 is employed. FIG. 3 is a graph showing the time-dependent change in the temperature of the device being preheated (in the case under discussion, the device is the thermal head body 66*a*).

As FIG. 3 shows, the thermal head body 66*a* is heated intermittently with the electric heater in a heating mode 80, so that its temperature increases stepwise from the current temperature $T_0$ to a preset temperature $T_1$ by following the curve 82. The preheating step ends at the point in time when the temperature of the thermal head body 66*a* has increased up to a value within the tolerable range of $T_1 \pm \Delta T$. If the temperature of the thermal head body 66*a* decreases by subsequent heat dissipation, the electric heater may be operated to impart a sufficient amount of heat in a temperature-holding mode 84 to maintain the temperature within the tolerable range of $T_1 \pm \Delta T$.

If the current temperature $T_0$, preset temperature $T_1$, heater's temperature (which is related to the applied voltage) and the period of intermittent heating are given, the time the thermal head 66*a* requires to be heated to the preset temperature $T_1$, namely, the initial heating time $t_2$ to achieve preheating, can be determined either experimentally or empirically.

Figure 4:
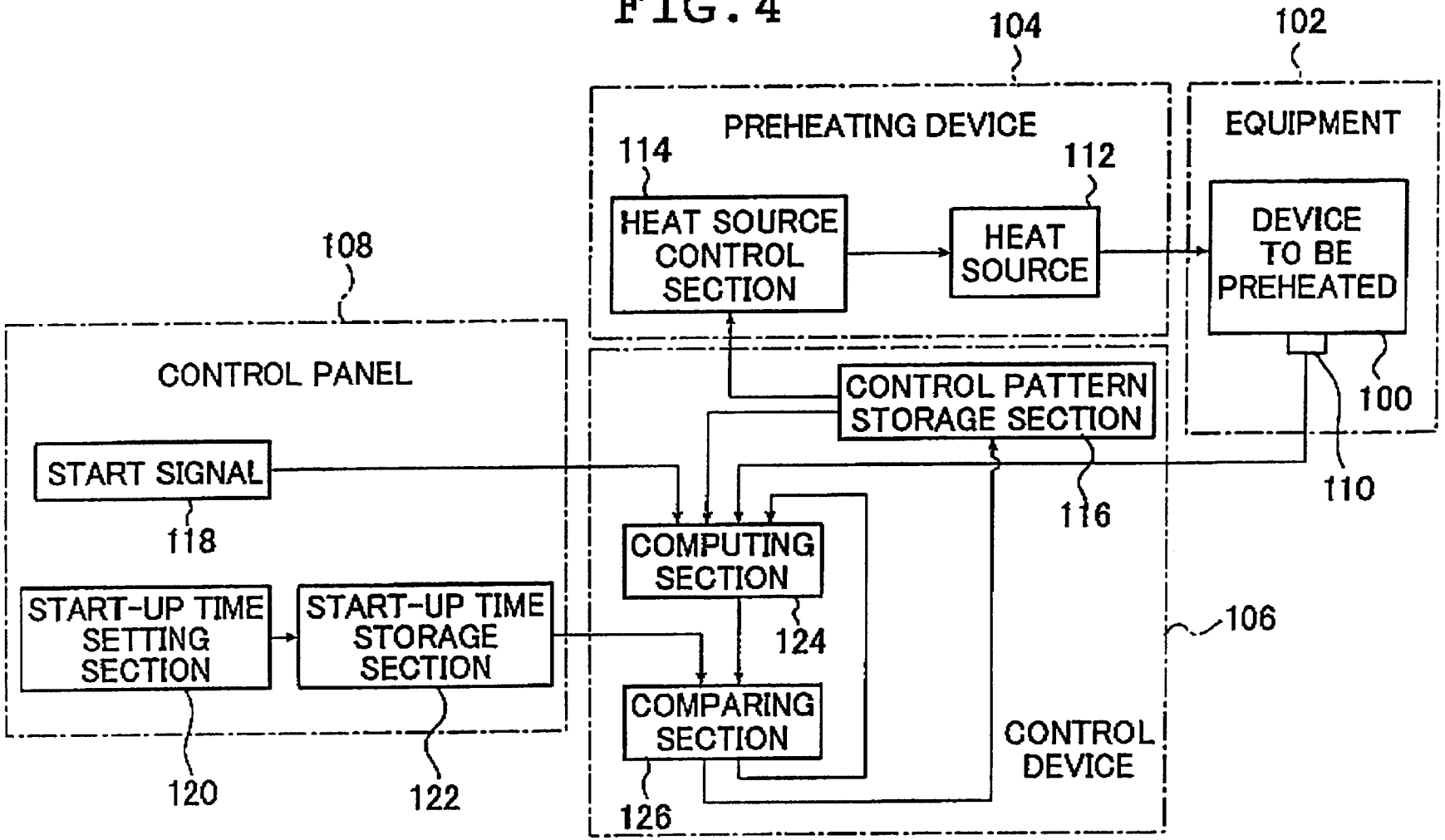
FIG. 4 is a block diagram for the apparatus of the invention for controlling the preheating temperature as it is applied to the thermal printer.
Figure 5:
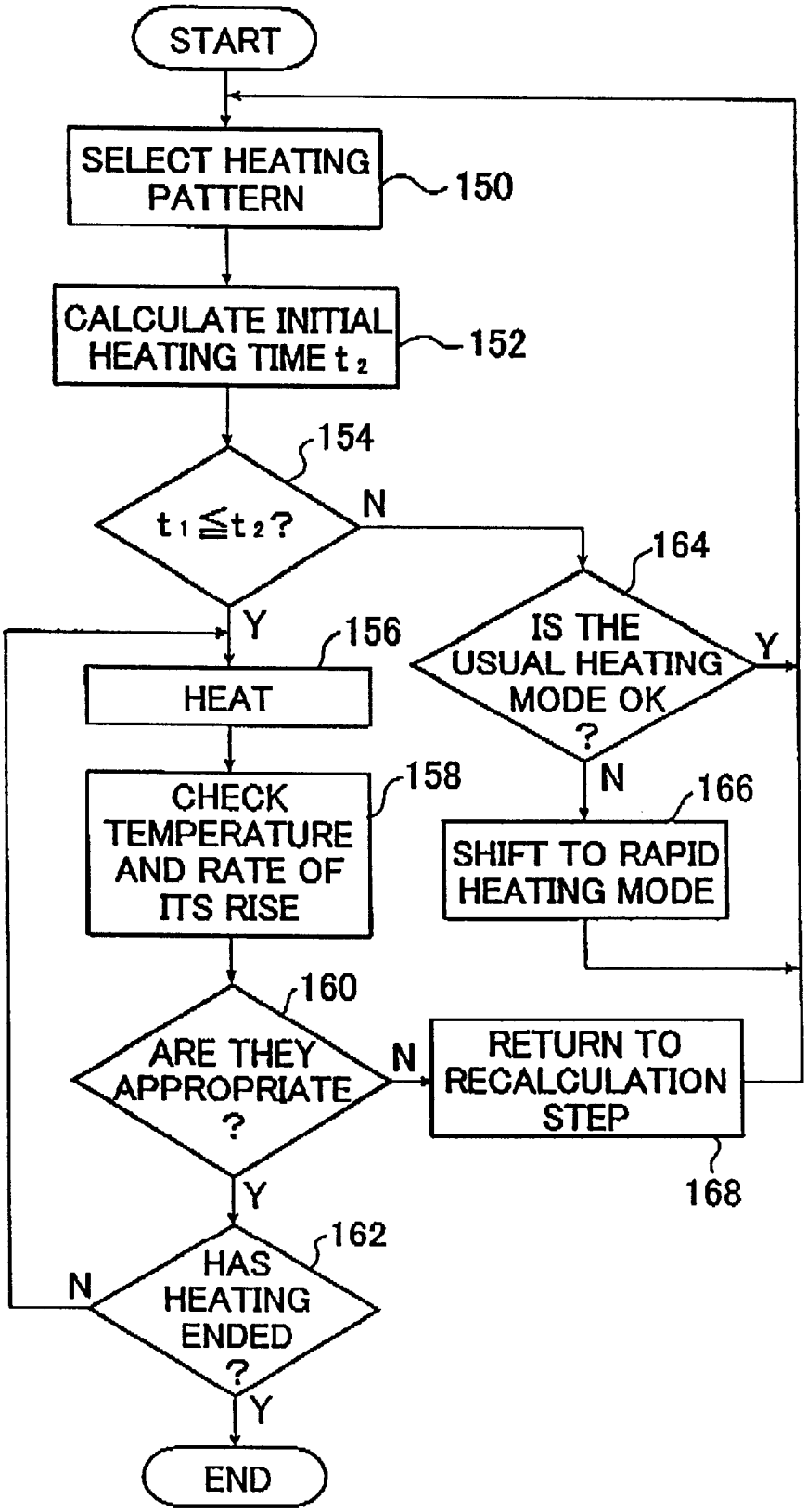
FIG. 5 is a flowchart illustrating the operation of the apparatus shown in FIG. 4.

FIG. 4 is a block diagram for the apparatus of the invention for controlling the preheating temperature as it is applied to the thermal printer. FIG. 5 is a flowchart for the operation of the apparatus. As FIG. 4 shows, the apparatus of the invention for controlling the preheating temperature in the example under consideration comprises equipment 102 (which is the thermal head 66 in its entirety in the case under consideration) which includes the thermal head body 66*a* as a device 100 to be preheated, a preheating device 104 for preheating the device 100, a control device 106 for controlling the preheating device 104, and a control panel 108.

The device to be preheated 100 is fitted with a temperature measuring device 110 which measures the current temperature $T_0$ at the start of preheating and which also performs subsequent temperature measurement as necessary to detect the elevation to the preset temperature $T_1$. Preheating device 104 comprises a heat source 112 and a heat source control section 114 which controls the heat source 112. According to a specified heating pattern as read from a control pattern storage section 116, the heat source control section 114 controls the heat source 112 so that the thermal head 66*a* which is the device to be preheated 100 is heated intermittently with the electric heater working as the heat source 112.

Control panel 108 is supplied with a preheat START signal 118 and it comprises a start-up time setting section 120 which sets a selected start-up time $t_1$ and a start-up time storage section 122 which stores the set value of start-up time $t_1$. Control device 106 also includes a computing section 124 and a comparing section 126. Computing section 124 determines the initial heating time $t_2$, or the time necessary to preheat the device 100 to the preset temperature $T_1$, by calculation on the basis of both the temperature detected by the temperature measuring device 110 on the device 100 and the specified heating pattern as read from the control pattern storage section 116. Comparing section 126 compares the thus predicted initial heating time $t_2$ with the start-up time $t_1$.

Being thus constructed, the apparatus for controlling the preheating temperature of equipment having a preheating device according to the example under consideration operates according to the flowchart shown in FIG. 5.

START signal 118 causes the control sequence to start. In a heating pattern selection step 150, a specified heating pattern is selected from the heating patterns stored in the control pattern storage section 116. Preferably, a standard heating pattern preset in the control pattern storage section 116 may first be chosen in step 150.

Then, on the basis of the selected heating pattern and the current temperature $T_0$ detected by the temperature measuring device 110, the initial heating time $t_2$ necessary to preheat the device 100 to the preset temperature $T_1$ is predicted in a computing step 152 by calculation with the computing section 124. In the next comparison step 154, the predicted initial heating time $t_2$ is compared with the start-up time $t_1$ by device of the comparing section 126. If $t_1 \leqq t_2$, it is concluded that preheating will end within the specified start-up time $t_1$ and the sequence goes to a heating step 156, where heating is started using the first selected standard heating pattern.

While the device 100 is being preheated in the heating step 156, its temperature is measured by the temperature measuring device 110 at appropriate intervals and checked up in a check step 158 together with the rate of its elevation. In a decision step 160, the measured temperature and the rate of its elevation are evaluated for their appropriateness. This procedure is repeated until the end of the heating process is confirmed in an end confirming step 162.

If $t_1$ is found to be greater than $t_2$ in the comparison step 154, the prediction is such that the preheating process will not end within the specified start-up time $t_1$ and more rapid heating is necessary. In this case, the sequence branches to a heating mode selection step 164 and a question is asked if the need for rapid heating can be met by the usual heating mode (i.e., without increasing the electric heater's temperature through application of a higher voltage but by merely shortening the non-heating time interval). If the answer is positive, a next heating pattern having a shorter non-heating time interval is selected in the heating pattern selection step 150 and the initial heating time $t_2$ is calculated again in the computing step 152 and compared with the preset start-up time $t_1$ in the comparison step 154. If this procedure is still incapable of producing the desired relationship $t_1 \leqq t_2$, it is repeated until a heating pattern is determined that gives the relationship $t_1 \leqq t_2$.

If it is concluded in the heating mode selection step 164 that a heating pattern that produces the relationship $t_1 \leqq t_2$ cannot be determined by using the usual heating mode, the sequence goes to a heating mode change step 166 and a suitable rapid heating mode such as the application of a higher voltage to the electric heater is chosen. Thereafter, the initial heating time $t_2$ is calculated again in the computing step 152 and compared with the preset start-up time $t_1$ in the comparison step 154. This procedure is repeated until a pattern that produces the relationship $t_1 \leqq t_2$ is determined.

As already mentioned, shortening the initial heating time $t_2$ by impressing a current on the electric heater continuously for a prolonged period or applying high voltage to provide a higher temperature will also shorten the life of the electric heater as heat source 66*c*. To avoid this problem, the standard heating pattern is preferably employed except in a case of emergency, where a shorter start-up time is set and preheating is finished within this time period.

If the preheating temperature or the rate of its elevation is found inappropriate in the decision step 160, the sequence branches to a recalculation step 168 to perform a second calculation of the temperature and the rate of its elevation. If the result is still inappropriate, there is high possibility that something abnormal has occurred to the equipment being preheated and it is preferable to display an alarm and stop the equipment to have it checked up.

While the apparatus and method of the present invention for controlling the preheating temperature have been described above in detail, the invention is by no device limited to the foregoing example and various improvements and modifications can of course be made without departing from its scope and spirit.

Thus, according to the present invention, preheating can be finished within a specified start-up period to ensure positive prediction of the waiting time so that the lapse of an unduly prolonged preheating time can be avoided. The invention offers a particular advantage when it is applied to medical equipment since in a case of emergency, a shorter preheating time can be set to minimize the period for which the patient has to wait.

What is claimed is:

1. An apparatus for controlling preheating temperature of equipment having a device to be preheated and a preheating device for start-up, said preheating device including a heat source and a heat source control device which has a plurality of heating patterns to control said heat source, said apparatus comprising:

a temperature measuring device for measuring current temperature of said device to be preheated within said equipment;

a computing device for calculating a predicted time that is required by said preheating device to preheat said device from the current temperature to a preset temperature;

a comparison device by which said predicted time as calculated by said computing device is compared with a specified start-up time; and a selecting device for selecting from said plurality of heating patterns within said heat source control device a heating pattern that makes said predicted time shorter than said start-up time.

2. The apparatus according to claim 1, wherein said specified start-up time can be set at a desired value.

3. The apparatus according to claim 1, wherein said equipment is medical equipment.

4. The apparatus according to claim 3, wherein said preheating device is one for said medical equipment.

5. The apparatus according to claim 3, wherein said device to be preheated is a thermal head in a thermal printer which prints out image data being output from said medical equipment and said preheating device is one for preheating said thermal head.

6. A method for controlling preheating temperature of equipment having a device to be preheated and a preheating device for start-up, comprising:

a current temperature measuring step for measuring current temperature of said device to be preheated within said equipment at start of preheating said device to be preheated by said preheating device;

a selection step for selecting one of the heating patterns possessed by said preheating device within said equipment;

a computing step for calculating a predicted time that is required to preheat said device to be preheated from said current temperature to a preset temperature; and a comparison step for comparing said predicted time with a specified start-up time; wherein if said predicted time is longer than said specified start-up time, another heating pattern is selected and said predicted time is calculated again so that an appropriate heating pattern is selected by repeating respective selection, computing and comparison steps until said predicted time becomes shorter than said specified start-up time.

7. The apparatus according to claim 5, wherein said specified start-up time can be set at a desired value.

8. The apparatus according to claim 5, wherein said equipment is medical equipment.

9. The apparatus according to claim 8, wherein said preheating device is one for said medical equipment.

10. The apparatus according to claim 8, wherein said device to be preheated is a thermal head in a thermal printer which prints out image data being output from said medical equipment and said preheating device is one for preheating said thermal head.

* * * * *